US007005018B2

(12) United States Patent
Julien

(10) Patent No.: US 7,005,018 B2
(45) **Date of Patent: *Feb. 28, 2006**

(54) SHAPE MEMORY PARTS OF 60 NITINOL

(75) Inventor: Gerald J. Julien, Edgewood, WA (US)

(73) Assignee: Nitinol Technologies, Inc., Edgewood, WA (US)

( * ) Notice: Subject to any disclaimer, the term of this patent is extended or adjusted under 35 U.S.C. 154(b) by 560 days.

This patent is subject to a terminal disclaimer.

(21) Appl. No.: 10/360,769

(22) Filed: Mar. 14, 2002

(65) Prior Publication Data

US 2004/0168752 A1 Sep. 2, 2004

Related U.S. Application Data

(63) Continuation-in-part of application No. 09/879,371, filed on Jun. 11, 2001, now Pat. No. 6,422,010.

(51) Int. Cl.
*C22F 1/10* (2006.01)
*C22K 1/00* (2006.01)

(52) U.S. Cl. ..... 148/563; 148/676

(58) Field of Classification Search ..... 148/563, 148/676

See application file for complete search history.

(56) References Cited

U.S. PATENT DOCUMENTS

| | | | | |
|---|---|---|---|---|
| 3,174,851 | A * | 3/1965 | Buehler et al. | 148/426 |
| 5,013,507 | A * | 5/1991 | Julien et al. | 264/219 |
| 5,986,169 | A * | 11/1999 | Gjunter | 424/422 |
| 6,422,010 | B1 * | 7/2002 | Julien | 60/527 |
| 2002/0187020 | A1 * | 12/2002 | Julien | 411/544 |

FOREIGN PATENT DOCUMENTS

WO WO-97/29892 A1 * 8/1997

* cited by examiner

*Primary Examiner*—George Wyszomierski
(74) *Attorney, Agent, or Firm*—J. Michael Neary

(57) ABSTRACT

A process for making Type 60 Nitinol with shape memory effect from hot-worked material, such as hot rolled Type 60 Nitinol sheet or plate, includes heat treatment to a temperature of 600° C.–800° C. and holding the material at that temperature until the temperature has equalized throughout, and then heat soaking at that temperature for about 15 minutes. The material is then quenched immediately from that temperature, to a temperature below 300° C. This heat treatment produces Type 60 Nitinol in a condition denoted "ultraelastic". Ultraelastic Type 60 Nitinol has a shape memory characteristic having a very low transition temperature. The transition temperature can be tailored within a wide temperature range by the temperature of the initial heat treatment and subsequent rate of cooling.

11 Claims, 3 Drawing Sheets

Process to obtain Shape Memory Effect Properties in 60 Nitinol

Process to obtain high hardness or Ultraelastic properties in 60 Nitinol

Process to obtain Shape Memory Effect Properties in 60 Nitinol

SHAPE MEMORY PARTS OF 60 NITINOL

This is a continuation-in-part of U.S. application Ser. No. 09/879,371 filed on Jun. 11, 2001. Now U.S. Pat. No. 6,422,010 and entitled "Manufacturing of Nitinol Parts and Forms".

This invention pertains to processes for making parts of a kind of Type 60 Nitinol having a shape memory effect, including heat treating processes to give the parts the desired mechanical properties of strength, toughness and shape memory, and to the parts made by the processes.

BACKGROUND OF THE INVENTION

Nitinol is a nickel-titanium intermetallic compound invented at the Naval Ordinance Laboratory in the early 1960's. It is a material with useful properties, but manufacturers who have worked with it have had little success in making Nitinol parts and semi-finished forms. Because Nitinol is so extremely difficult to form and machine, workers in the metal products arts usually abandoned the effort to make products out of anything except drawn wire because the time and costs involved did not warrant the paltry results they were able to obtain.

The most commonly used kinds of Nitinol are superelastic and shape memory Type 55 Nitinol, an intermetallic compound having 55% nickel and 45% titanium by weight. Superelastic Nitinol achieves its properties of high elastic elongation by processes including substantial cold working. It is used almost exclusively in the form of wire, the drawing of which imparts the cold working.

Type 60 Nitinol is an intermetallic compound having 60% Nickel and 40% Titanium by weight. It has many properties that have been unrecognized as of potential value. It can be polished to an extremely smooth finish, less than 1 microinch rms. It is naturally hard and can be heat treated to a hardness on the order of 62Rc or higher. It can be processed to have a very hard integral ceramic surface that can itself be polished to an even smoother surface than the parent metal. It is non-magnetic, immune to corrosion from most common corrosive agents, and has high yield strength and toughness, even at elevated temperatures. It is 26% lower density than steel for weight sensitive applications such as aircraft, satellites and spacecraft. However, there has hitherto been little effort in making useful parts out to Nitinol because it is so difficult to work, because it was known to be brittle, and because there has been no known method to make parts and forms out of Type 60 Nitinol.

In my co-pending application Ser. No. 09/879,371, the disclosure of which is incorporated by reference herein, I describe a process for imparting properties, unknown until my discovery thereof, of high elasticity, toughness, and shape memory effect to Type 60 Nitinol. I have, since the filing of that application, refined the processes and made additional discoveries that enable the tailoring of the transition temperature of the shape memory effect in Type 60 Nitinol. I have also discovered that ultraelastic Type 60 Nitinol is itself a shape memory effect material with a very low transition temperature. The range and value of the applications of these materials are beyond imagination.

SUMMARY OF THE INVENTION

Accordingly, this invention provides several processes for making Type 60 Nitinol with desirable mechanical properties of hardness, toughness, elasticity and shape memory effect. The processes include selecting a sheet or plate of hot-rolled Type 60 Nitinol and heat treating the sheet or plate to reduce brittleness and improve toughness and impact strength, and give the parts and forms made of Type 60 Nitinol a highly elastic property which I have denoted "ultraelasticity". Parts can be cut from the sheet or plate after heat-treating. Preferably, the parts are cut from the sheet or plate before heat treating since heat treatment of large sheets or plates and the subsequent cooling is more difficult than that required for smaller parts after cutting from the sheet or plate.

To reduce the part to the desired thickness, and to remove any surface flaws and produce a smooth surface finish, it may be surface ground with silicon carbide grinding media, or with a 3M grinding belt with "Cubitron" or "Trizak" grinding media. For parts requiring a smooth surface finish, polishing or lapping provides the specified surface finish on the part, down to 0.5 microinch RMS or finer. The part may be heat treated to obtain the desired hardness, from RC40 to RC65.

An integral surface oxide of any of several colors can be formed on the surface of the part. The oxide surface may itself be polished to an even finer surface finish. These process elements may all be used to produce a particular part that requires the characteristics provided by each process element, and they may be used in combinations that omit particular process elements or substitute others to give the desired characteristics of the part.

Shape memory effect in Type 60 Nitinol, never before known to exist, may be obtained by heat treating to a temperature in the range of about 675° C.–850C., and then cooling the part at a predetermined cooling rate to achieve the desired transition temperature.

DESCRIPTION OF THE DRAWINGS

The invention and its many attendant benefits and advantages will become better understood upon reading the following detailed description of the preferred embodiments in conjunction with the following drawings, wherein.

DETAILED DESCRIPTION OF THE PREFERRED EMBODIMENTS

Figure 1:
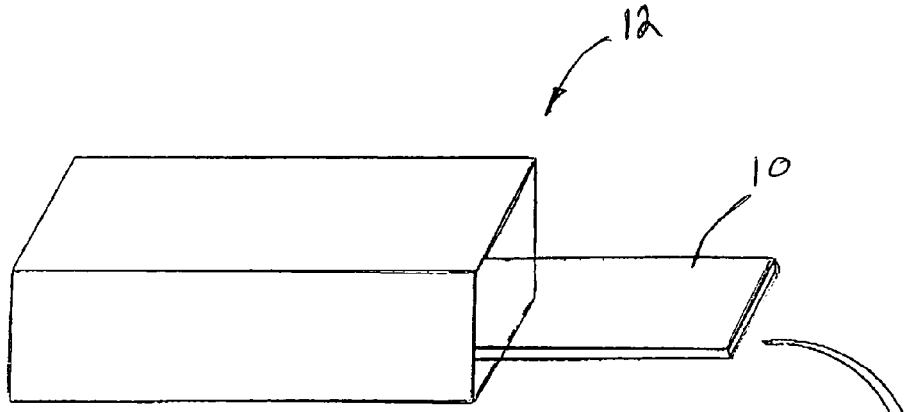
FIGS. 1–3 are schematic diagrams illustrating portions of the process for producing ultraelastic Type 60 Nitinol in accordance with this invention.

"Nitinol Forms" as used herein are semi-finished shapes such as rods, plates, bars, rings and tubes. "Nitinol parts" as used herein are parts made from Nitinol forms in accordance with this invention.

Nitinol is a family of intermetallic materials containing nickel and titanium. Nitinol was invented at the U.S. Naval Ordnance Laboratory in White Oak, Md. and was named to indicate its composition and origin of development: Nickel Titanium Naval Ordinance Laboratory. The best known Nitinol composition is Type 55 Nitinol, containing a nearly equal atomic mixture of nickel and titanium, which is about 55% by weight nickel and about 45% by weight titanium.

Other elements, including iron, and copper are sometimes added to modify the material properties, such as transition temperature.

Another lesser known and understood intermetallic compound of Nitinol, Type 60 Nitinol, has a composition of about 60 weight % nickel and about 40 weight % titanium. This material has properties of hardness and strength that significantly exceed those of Type 55 Nitinol, but has not been accepted commercially because it was thought to be too difficult to work and machine, and was thought to have properties that made it undesirable as a structural material, namely, brittleness, notch sensitivity, and an unpredictable tendency to explode when cooling after heating and during forging.

The properties of Type 55 Nitinol materials for consumer and medical applications are known and many applications have been developed for these materials. Two unique characteristics which Type 55 Nitinol exhibits are denoted by the terms "Shape Memory" and "Superelasticity".

Shape memory effect describes the process of restoring the original shape of a plastically deformed sample by heating it to a temperature above the transition temperature, resulting in a crystalline phase change known as "thermoelastic martensitic transformation". Below the transition temperature, Type 55 Nitinol has a soft martensitic microstructure characterized by "self-accomodating twins", a zigzag like arrangement. Martensite is easily deformed by de-twinning. Heating the material above the transition temperature converts the material to its high strength, austenitic condition. The transformation from austenite to martensite (cooling) and the reverse cycle from martensite to austenite (heating) does not occur at the same temperature. There is a hysteresis curve for every Nitinol alloy that defines the complete transformation cycle. The shape memory effect is repeatable and can typically result in up to 8% strain recovery.

Martensite in Nitinol can be stress induced if stress is applied in the temperature range above Af(austenite final temperature). Less energy is needed to stress-induce and deform martensite than to deform the austenite by conventional mechanisms. Up to 8% strain can be typically accommodated by this process. Since austenite is the stable phase at this temperature under no-load conditions, the material springs back to its original shape when the stress is removed. This extraordinary elasticity is called "pseudoelasticity" or transformational "superelasticity". The typical curve of a properly processed Nitinol alloy shows the loading and unloading plateaus, recoverable strain available, and the dependence of the loading plateau on the ambient temperature. The loading plateau increases with the ambient temperature. As the material warms above the austenite final temperature, the distinctive superelastic "flag" curve is evident. Upon cooling, the material displays less elasticity and more deformation until it is cooled to where it is fully martensite; hence, exhibiting the shape memory property and recovering its deformation upon heating. However, Type 55 Nitinol alloys are superelastic in a temperature range of approximately only 50 degrees above the austenite final temperature. Alloy composition, material processing, and ambient temperature greatly effect the superelastic properties of the material. For the medical device community, binary Nitinol alloys, when processed correctly, are at their optimal superelastic behavior at body temperature, but for typical industrial and military applications, the small temperature range of superelasticity of Type 55 Nitinol can be a serious limitation because they often can be expected to operate at temperatures outside that range.

Superelastic Nitinol is a known composition, very nearly the same as 55 Nitinol, but is cold worked to give it remarkable elastic properties. Although providing somewhat less damping capacity than the 55 Nitinol, superelastic Nitinol also has good damping capacity. The combination of extreme elasticity (technically known as "pseudoelasticity") and damping capacity may make superelastic Nitinol a better material in some applications. Nitinol in its Martensitic state has very high damping capacity, on the order of 40% of input strain energy. Superelastic Nitinol also has a high damping capacity after it reaches its pseudoelastic range, but it requires a degree of strain before it becomes a good damping material.

Ultraelasticity

The interesting properties of pseudoelasticity and shape memory have not been thought to exist in Type 60 Nitinol. Indeed, Type 60 Nitinol has been thought to have no significant elastic properties at all. It has been thought to be too brittle and notch-sensitive to serve as an engineering or structural material. However, I have discovered that Type 60 Nitinol can be processed to a state at which it exhibits significant elasticity, which I am calling "ultraelasticity" to distinguish it from "superelasticity" of Type 55 Nitinol. The metallurgical mechanisms that produce ultraelasticity are not fully understood at this time, but the elastic properties of Type 60 Nitinol, properly processed in accordance with this invention, are readily demonstrated in standard objective tests on sample coupons, and also in practical application of the material in applications previously possible only with superelastic Type 55 Nitinol.

The properties of ultraelastic Type 60 Nitinol are as follows:

Elastic range: up to about 6%–7% strain.

Temperature range in which ultraelasticity is exhibited: −150° C. to at least about 600° C. and maybe as high as 750° C.

Ultraelastic Type 60 Nitinol also has the following useful properties: hardness that is adjustable from about 22RC up to about 64RC, low density, high strength (at higher hardness heat treats), low modulus, takes a fine surface finish, low CTE, low thermal conductivity, corrosion resistant, and non-magnetic. At low hardness (22 RC–35RC), it has very low yield strength (15KSI–55KSI) and little elasticity, that is, it can easily be plastically deformed with little springback, and is very malleable, that is, can be extensively deformed or strained without cracking. Ultraelastic Nitinol, in a previously unknown characteristic, is a shape memory effect material. It can be cooled to a low temperature at which it becomes martensitic, or transforms to a martensite-like state characterized by low yield strength, ductility, and high damping capacity.

The processes for producing ultraelasticity in a Type 60 Nitinol semi-finished form or workpiece include melting Type 60 Nitinol by conventional methods in a vacuum furnace. The type of furnace is not critical but is preferably melted in a draw-down graphite crucible for casting into a billet or ingot 10 of a size that is suitable for hot working. I prefer to use small ingots about 4"–5" square or in cylindrical diameter and about 2'long" for convenience to casting operations which often are limited to ingots of that size. Moreover, I believe a smaller grain size is obtained in the smaller ingots. Alternatively, a larger ingot can be cut or forged into a size that is suitable for hot working, although larger ingots have not worked well for me in this process. The exact reason for this difference is not entirely clear to me, perhaps because the grain size in a larger ingot tends to be larger than the grain size in a smaller ingot. Smaller "ingots" intended for rolling can also be cast such as plates 1"–2" thick, 30" wide (or whatever the width of the rolling mill is) and 1'–2' long.

Figure 2:
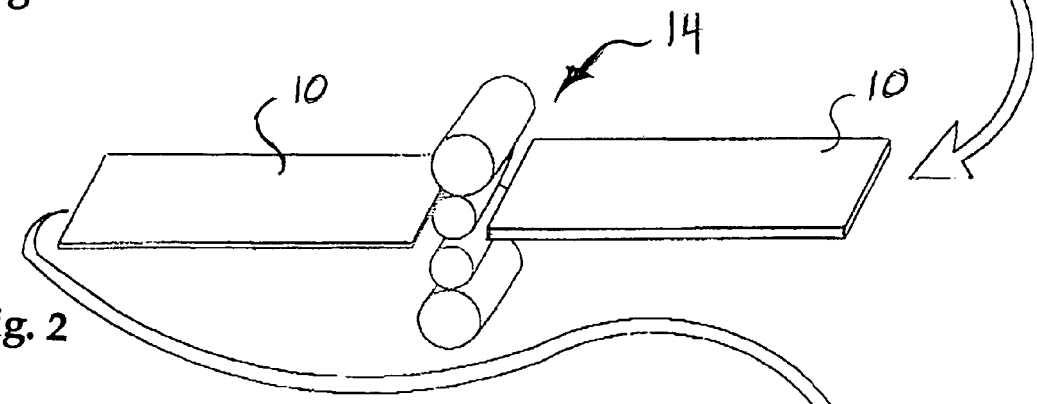
Figure 3:
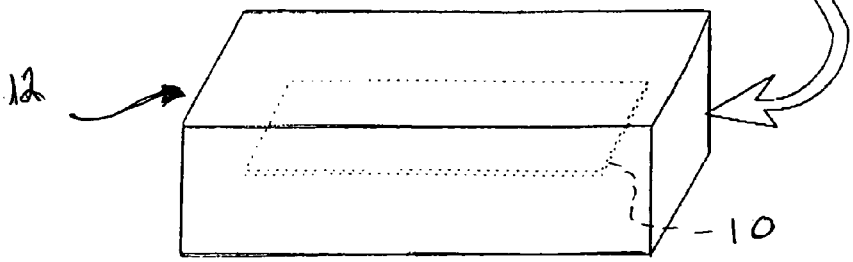

As illustrated in FIGS. 1–3, the ingot 10 or workpiece is heated in a heater 12, such as an oven or furnace or the like, to a working temperature of about 900° C.–950° C. The ingot 10 or workpiece should be held at the working temperature for long enough for the heat to penetrate entirely to its core and for a soak period at that temperature. I have found that a heating period of at least one hour at that temperature is usually enough for plate of ½–¾" thick. The heated plate 10 or workpiece is removed and subjected to hot working in a hot working apparatus 14 by rolling, forging or the like to reduce its dimension toward the desired thickness and length. "Hot-working" is defined as straining the workpiece by about 20%, more or less, while holding it at the working temperature. Examples of hot-working include forging, rolling, hot extrusion, and machining. Another "hot working" method is to subject a cast part to isostatic pressure at elevated temperature for several hours, although there is some doubt that a cast part that is not strained to about 20% in a hot working process would not attain the desired properties of toughness and elasticity.

Preferably, the tools and/or tooling used in the hot-working are insulated or insulating so that their contact with the hot workpiece does not quench its surface region below the working temperature. Pack rolling the Nitinol plate 10 between heated steel sheets is one effective technique to reduce the quenching effect. Tools and tooling made of Type 60 Nitinol are preferred because it is very hard and strong, even at elevated temperatures, and because the low thermal conductivity of Type 60 Nitinol reduces the rate of heat flux out of the workpiece.

It is best to ensure that the temperature of the ingot 10 or workpiece be maintained above about 900° C. while it is being worked because it loses malleability, so cracks could be initiated in the ingot or plate 10 by hot working below 900° C. Such cracks could cause flaws in the material and should be prevented or ground out. Moreover, the strain rate of the hot working should be slow because Type 60 Nitinol is a strain rate sensitive material and impact strains have been observed to cause catastrophic shattering of the ingot which could be dangerous for the workers, equipment, and elevated levels of employee anxiety in the vicinity. I have found that I obtain the best results in rolling by limiting the thickness reduction to about 5–15 mils per roller pass, preferably 5–6 mils per roller pass. However, as long as the ingot or plate 10 is maintained at the designated working temperature, greater reductions should be possible.

After the initial hot working, the plate is returned to the furnace and reheated to the working temperature of 900° C.–950° C. for a second pass through the hot working apparatus, such as the rolling mill 14. After a few rolling and reheating iterations, the plate can be heated to a lower working temperature of 800° C.–900° C., and is allowed to soak at that temperature long enough to completely reheat the plate through to the core. The reheated plate is now re-rolled, at the lower working temperature. Rolling at the lower working temperature proceeds smoothly without breaking or cracking the plate 10. I am not sure why the later hot working passes can be done at a lower temperature. It may be that the initial hot working reduces the grain size and/or the reheating reduces the presence of hardening precipitates. Whatever the reason, the later hot working passes are smoother than the earlier ones. Rolling is repeated until the plate is elongated and reduced in thickness the desired amount.

The rolled plate 10 produced by this series of heating and rolling steps is very hard and brittle. To obtain the desired ultraelastic properties, the plate 10 is now returned to the oven 12 as shown in FIG. 3 and heated to about 500° C.–700° C. and held at that temperature for a post-hotwork heat soak period for 15–60 minutes or longer, for example, several hours. At the end of the post-hotwork heat soak period, the plate 10 is removed from the oven 12 and is quenched to reduce its temperature quickly. This post-hotwork heat soak and quench process can be used on rolled plate, extrusions, and other hot-worked parts and forms. Alternatively, parts may be cut from the plate 10 by laser or water jet, and the parts may be heat treated as noted above instead of the plate 10.

I believe a metallurgical change occurs during the post-hotwork heat soak and quench. Although the precise nature of that change is not yet clear to me, I believe that the hot working or casting produces hardening precipitates and that the hot soak period in the region of 700° C. dissolves or otherwise removes or reduces those precipitates to give the plate its ultraelastic properties.

Figure 4:
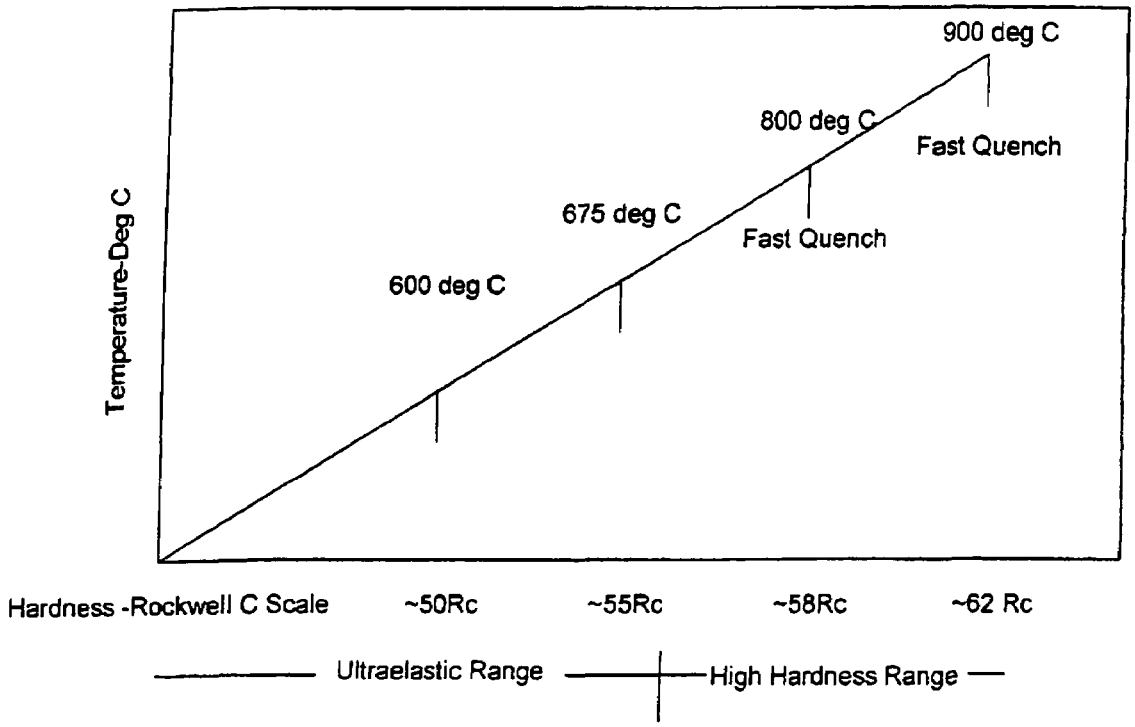
FIG. 4 is a graph of temperatures to which Type 60 Nitinol is heated to obtain ultraelastic elasticity, and some resulting properties.

The ultraelastic Type 60 Nitinol workpiece may be heat treated to a desired combination of hardness and elasticity as illustrated in FIG. 4. For example a hardness of about 58RC–64RC may be obtained by heating it to about 900° C.–950° C. and then quenching in water or other coolant such as water or oil to cool it quickly to a temperature below about 500° C. The coolant should be agitated or the part moved in the coolant bath to ensure a flow of coolant over the surface of the part to ensure even cooling and prevent development of an insulating steam cushion over portions of the part. As shown in FIG. 4, the hardness can be tailored by the temperature of the initial heating. Rapid quenching produces a surface hardness of about 58–64RC at some sacrifice to the elasticity of the material. The strength of the ultraelastic Type 60 Nitinol heat treated to about 50–55 Rockwell C and a strength of about 140,00–155,000 psi and has an elastic strain capability of about 3% up to about 6%.

To retain the ultraelastic properties in a portion of the workpiece but high hardness in other portions such as the cutting edge of a cutting instrument, the portion that need not be hardened can be clamped in a heat sink and the other portion, such as the knife or saw edge, is heated to a hardening temperature of 900° C.–950° C. and then rapidly quenched in water or other coolant. The heat sink prevents the unhardened portion from being heated to the hardening temperature so it retains its ultraelastic properties.

After rapid quenching, the workpiece has a tendency to age harden over a period of several days, producing an increased hardness that may be undesirable. To prevent this age hardening, the workpiece may be heated in boiling water or oven heated to 300° C.–600° C. for several hours and then furnace cooled over several hours or removed and allowed to air cool to room temperature.

Shape Memory Effect

To obtain shape memory effect in Type 60 Nitinol, it is heat treated and cooled in accordance with a particular schedule. Starting with a workpiece that has been hot-worked, as by hot rolling Type 60 Nitinol plate or rotary hot swaging cast rods or tubes of Type 60 Nitinol, the hot-worked workpiece is heated in an oven to a temperature between 500° C. and 800° C., preferably between 675–700° C., and held at that temperature until the temperature has equalized throughout the workpiece, and for a soak time of about 15–30 minutes. The oven is then turned off and allowed to cool slowly reaching ambient temperature. The cool-down is preferably in the oven, with the doors closed to prevent drafts and uneven or rapid cooling, over a period of 10–12 hours. The workpiece that is removed from the oven has the following properties:

Low hardness: 22 RC–28 RC

Low yield strength: 50,000 psi

Ultimate tensile strength: 137,000 psi.

High ductility: can be bent and otherwise strained extensively without cracking or rupturing.

High energy absorbing capacity or damping capacity, believed to be on the order of about 40%.

Shape memory effect: can be strained to about 5% and returns to the unstrained shape when heated to about 75° F.–180° F., or possibly higher.

Figure 5:
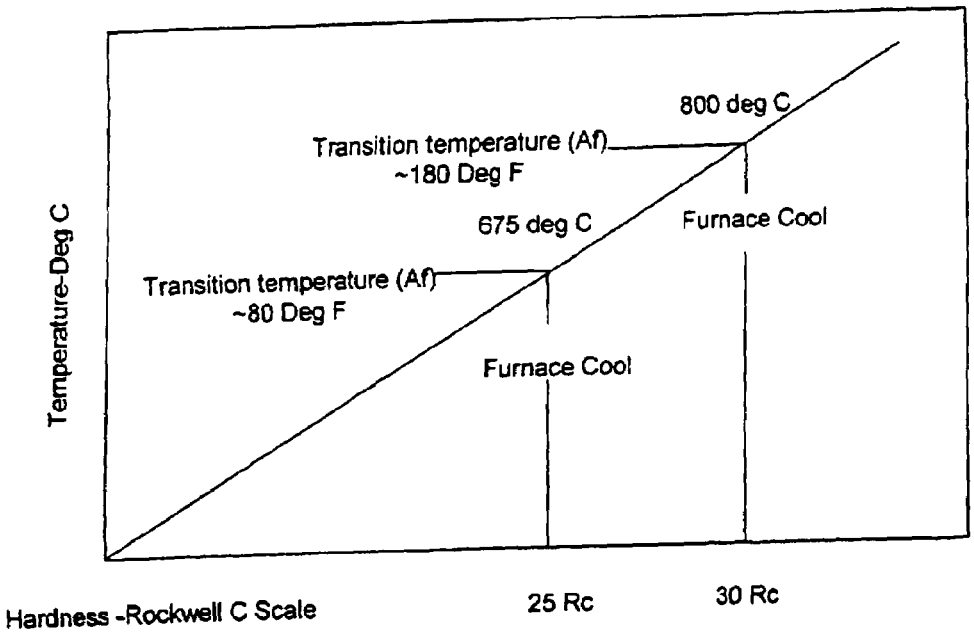
FIG. 5 is a graph of temperatures to which Type 60 Nitinol is heated to obtain shape memory effect properties, and some hardness properties and transition temperatures that result from the process.

The transition temperature can be tailored to the desire temperature within the range noted above by selecting the temperature to which the part is heated before the slow cool-down, as shown in FIG. 5. The transition temperature of ultraelastic Type 60 Nitinol is also influenced by the initial heat treat temperature.

The Type 60 Nitinol that is heat treated in this way can then be cold-rolled by about ½% strain without significant difficulty, since it has low hardness and yield strength. Cold rolling in this way elevates the transition temperature from about 160° F. $A_f$ to about 180° F. $A_f$. Cold rolling produces stress induced austenite and, if additional cold rolling thickness reduction is desired, the material must again be heat treated as noted above to return it to the soft martensite condition before the next rolling pass.

The transition temperature for the shape memory effect can be controlled by the original heat treatment, and by the temperature cool-down rate. Heating the Type 60 Nitinol to 800° C. and furnace cooling over about 12 hours to room temperature produces a $A_s$ temperature of 75–80° F. and an $A_f$ temperature of 160° F. Heating to 675 followed by an immediate water quench produces an $M_f$ temperature of about 20° F. Heating to about 700° C. followed immediately by a water quench to room temperature produces an $M_f$ temperature of about −20° F. Heating to about 700° C. followed by furnace cooling over about 12 hours to room temperature produces an $M_f$ temperature of about +100° F. Heating to about 750° C. followed immediately by a water quench to room temperature produces an $M_f$ temperature of below about −60° F.

Shape memory Nitinol can be used as a structural component in vehicles, where Type 55 Nitinol cannot be used because of its lower strength and creep characteristics. It can also be used in rotary actuators, as disclosed in the parent application to this one. Type 60 Nitinol does not have the troublesome creep characteristics of Type 55 Nitinol, and provides a recovery force of about 100Llb/in$^3$.

Type 60 Nitinol having the shape memory effect has many potential uses. A tube of this material can be strained by pulling a ball slightly larger than the bore of the tube through the bore to increase the inner diameter of the tube. The strained tube can then be slid over another tube, such as a gun barrel, and heated to shrink the Type 60 Nitinol sleeve onto the gun barrel. The resulting assembly could then be heat treated to give the Type 60 Nitinol the desired properties of strength.

This method of making gun barrels provides a contraction of the outer portion of the gun barrel and resulting compression of the inner portion around the bore to improve the burst pressure of the gun barrel. This is much simpler than the conventional shrink fitting which is not much used because of the difficulty of assembling hot and cold tubes rapidly enough to nest them completely before they equalize in temperature enough to grow into interference and prevent further nesting. It is also simpler and easier to control than autofrettage, which requires the imposition of stress in the bore sufficient to plastically strain the inner portions of the barrel while straining the outer portions less, within the elastic limit. This is a difficult operation, especially for tapered gunbarrels, and even minute variations in the parameters of the process can result in large variations of the properties.

Shape memory Type 60 Nitinol also has potential use in medical applications, such as stents and orthodontics, as well as self-installing pipe liners and blind fasteners.

Machining

Machining the Type 60 Nitinol can be done in a temperature range from about 400° C.–500° C. to about 950° C., but there is a narrow temperature band that should be avoided. Just below 800° C., the material becomes very hard and is dangerous to machine because it breaks the cutting tools and produces high velocity hot fragments that are a threat to workers and equipment in the vicinity. The material may also be machined at room temperature with silicon carbide cutters at a shallow cutting depth and low feed rate.

Obviously, numerous modifications and variations of the preferred embodiment described above are possible and will become apparent to those skilled in the art in light of this specification. For example, the process is useful for producing products not specifically mentioned herein, e.g. cutting instruments such as knives, chipper blades for wood chippers and brush chipper/shredders, razor blades and scalpels. Many other products may be produced, such as bearing races, guides and ways for machine tools and machinery, and gun barrels. Moreover, many functions and advantages are described for the preferred embodiment, but in many uses of the invention, not all of these functions and advantages would be needed. Therefore, I contemplate the use of the invention using fewer than the complete set of noted features, process steps, benefits, functions and advantages. For example, all the process elements may be used to produce a particular part that requires the characteristics provided by each process element, or alternatively, they may be used in combinations that omit particular process elements or substitute others to give the desired characteristics of the part. Moreover, several species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly intended that all these embodiments, species, modifications and variations, and the equivalents thereof, in all their combinations, are to be considered within the spirit and scope of the invention as defined in the following claims, wherein I claim:

What is claimed is:

1. A process of making parts and farms of Type 60 Nitinol that have shape memory, comprising:

selecting a workplace of Type 60 Nitinol that has been hot-worked;

heating said type 60 Nitinol workpiece in an oven to a heat-treatment temperature of about 500° C.–800° C., and held at that temperature until the temperature has equalized throughout said workpiece, and for a soak time of about 15–30 minutes thereafter;

allowing said workpiece to cool slowly and evenly over a cool-down period of at least about 10 hours to ambient temperature.

2. A process as defined in claim 1, wherein:

said workplace is heated to a heat-treatment temperature of between 675° C. and 700° C. in said oven and then allowed to cool slowly to ambient temperature.

3. A process as defined in claim 1, wherein:

after cooling, said workplace has attained a metallurgical transformation to a soft and malleable condition of about 50 KSI yield strength, and an ultimate tensile strength of about 137,000 psi.

4. A process as defined in claim 1, wherein:

after cooling, said workpiece has attained a metallurgical transformation to a soft and malleable condition of about 50 KSI yield strength, and a high energy absorbing capacity or damping capacity, on the order of about 40%.

5. A process as defined in claim 1, wherein:

after cooling, said workpiece has attained a shape memory effect wherein said workpiece is capable of being strained from an unstrained shape to a strained shape of about 5% strain; then, when heated to a specific transition temperature of about 75° F.–180° F., said workpiece spontaneously returns to said unstained shape.

6. A process as defined in claim 5, wherein:

said specific transition temperature at which the shape memory effect restoring force occurs may be varied by selecting said heat-treating temperature within said range of about 600°C. and about 800°C., and selecting said cool-down time.

7. A process as defined in claim 5, wherein:

after reheating said strained workpiece to said transition temperature, said workpiece provides a recovery force of about 100LIb/in$^3$T and returns fully to said unstrained shape without creep.

8. A process for producing shape memory characteristics in a Type 60 Nitinol workpiece, comprising:

selecting a workpiece of Type 60 Nitinol;

heating said workpiece to a heat-treating temperature of between about 600° C. and about 800° C. and holding said workpiece at mat temperature until the temperature has substantially equalized throughout said workpiece;

cooling said workpiece slowly in the furnace over a cool-down period of at least about 10 hours to effect a metallurgical transformation to a soft and malleable condition of about 50 KSI yield strength, but ultimate tensile strength of about 137,000 psi;

whereby said part is capable of being deformed while in said soft and malleable condition; and said deformed part, when allowed to warm to a temperature above a specific temperature, will spontaneously exert a restoring force tending to restore said part to said pre-deformed condition.

9. A process as defined in claim 8, wherein:

said specific temperature at which the shape memory effect restoring force occurs may be varied by selecting said heat-treating temperature within said range of about 600° C. and about 800° C., and selecting said cool-down time.

10. A process as defined in claim 8, wherein:

said workpiece, after heat treating and cooling, has a high energy absorbing capacity or damping capacity on the order of about 40%.

11. A process of making parts of Type 60 Nitinol having a shape memory effect, comprising:

selecting a Type 60 Nitinol workpiece that has been hot-worked at a temperature of about 900° C. to 950° C. to a reduction of at least about 2% in the dimension of said hot-working;

heat treating said hot-worked workplace to produce said desired properties, said heat treating including heating said workpiece to at least about 600° C. to about 800° C. and allowing said heated workpiece to cool slowly over a period of about at least 10 hours to ambient temperature to produce a part in a martensitic state having a low yield strength of about 50 KSI;

whereby, said martensitic part is capable of being deformed at a temperature below about −10° F. while in said martensitic condition; and when said deformed part is allowed to warm to a temperature above about −10° F., it will spontaneously exert a restoring force tending to restore said part to said pre-deformed condition.

* * * * *